United States Patent [19]

Downing

[11] B 3,989,970

[45] Nov. 2, 1976

[54] METAL HALIDE HIGH-INTENSITY DISCHARGE LAMP HAVING IMPROVED RESTART CAPABILITY

[75] Inventor: Robert D. Downing, Mentor, Ohio

[73] Assignee: General Electric Company, Schenectady, N.Y.

[22] Filed: Dec. 19, 1974

[21] Appl. No.: 534,443

[44] Published under the second Trial Voluntary Protest Program on January 27, 1976 as document No. B 534,443.

[52] U.S. Cl. ..... 313/42; 313/45

[51] Int. Cl.[2] ..... H01J 61/52

[58] Field of Search ..... 313/42, 43, 45

[56] References Cited

UNITED STATES PATENTS

| | | | |
|---|---|---|---|
| 2,579,109 | 12/1951 | Davies et al. | 313/42 |
| 3,259,777 | 7/1966 | Fridrich | 313/184 |
| 3,685,880 | 8/1972 | Sobieski | 316/19 |
| 3,780,342 | 12/1973 | Grimshaw et al. | 315/173 |

FOREIGN PATENTS OR APPLICATIONS

| | | | |
|---|---|---|---|
| 465,137 | 5/1937 | United Kingdom | 313/43 |

*Primary Examiner*—R. V. Rolinec
*Assistant Examiner*—Darwin R. Hostetter
*Attorney, Agent, or Firm*—Norman C. Fulmer; Lawrence R. Kempton; Frank L. Neuhauser

[57] ABSTRACT

A metal halide high-intensity arc discharge lamp having a bulb containing elongated electrodes of a refractory metal such as tungsten, and means connecting the electrodes through seals of the bulb to external terminals. Cooling means such as metal fins are provided at the external terminals and function to cool the electrodes relatively quickly whenever the arc discharge terminates, without substantially affecting the desired high operating temperature of the electrodes. The faster cooling of the electrodes upon termination of the arc discharge permits the lamp to be restarted sooner.

6 Claims, 2 Drawing Figures

METAL HALIDE HIGH-INTENSITY DISCHARGE LAMP HAVING IMPROVED RESTART CAPABILITY

BACKGROUND OF THE INVENTION

The invention is in the field of high-intensity, high-temperature arc discharge lamps containing a metal halide gas, such as is disclosed in U.S. Pat. No. 3,259,777 to Elmer G. Fridrich. Such lamps are useful, for example, in photographic projectors and other optical devices requiring a compact high-intensity light source of high efficiency. The metal halide gas may be produced, for example, by a salt of iodide such as indium triiodide which converts to iodine gas due to the high temperature of the operating lamp. A starting gas, such as argon, can be included in the lamp to aid in starting.

In such a lamp, after it comes up to operating temperature, the inner tips of the tungsten electrodes are molten and vaporize, and the halogen gas in the lamp causes a regenerative cycle to occur which carries the vaporized tungsten back to the electrodes and prevents it from depositing onto (and blackening) the bulb wall, as is more fully described in the above-referenced Fridrich patent.

It has been found that a lamp of this type, if the arc discharge becomes disrupted momentarily, such as by a momentary interruption of current furnished to the lamp, cannot be restarted for a period of time, such as up to one minute or so. This is considered by some to be an undesirable characteristic of an otherwise highly desirable lamp, especially when used in motion picture projectors, and as reprographic lamps such as plate burner lamps in printing equipment.

SUMMARY OF THE INVENTION

Objects of the invention are to provide an improved metal halide high-intensity discharge lamp, and to improve and quicken the restart capability of such a lamp.

The invention comprises, briefly and in a preferred embodiment, a metal halide high-temperature, high-intensity arc discharge lamp having a bulb containing elongated electrodes of a refractory metal such as tungsten, and means connecting the electrodes through seals of the bulb to external electrical terminals. Cooling means such as a heat sink or metal fins are provided at the external terminals and function to cool the electrodes relatively quickly whenever the arc discharge terminates without substantially affecting the desired high operating temperature of the electrodes. This faster cooling of the electrodes upon termination of the arc discharge permits the lamp to be restarted sooner, for example in half a minute instead of one minute. This is a considerable benefit, for example, when a movie is being shown with a projector using such a lamp and the discharge is terminated by a momentary disruption of current furnished by the power supply.

DESCRIPTION OF THE PREFERRED EMBODIMENTS

Figure 1:
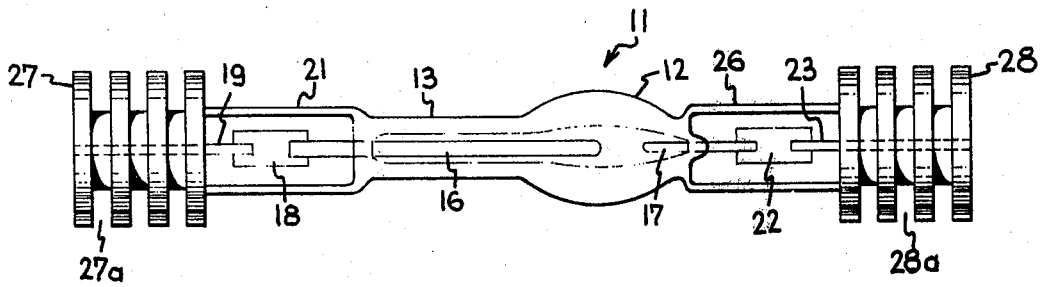
FIG. 1 is a side view of a metal halide high-intensity discharge lamp in accordance with a preferred embodiment of the invention.
Figure 2:
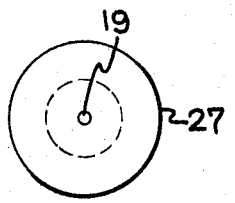
FIG. 2 is an end view of the lamp of FIG. 1.

The lamp shown in the drawing is a compact high-intensity arc discharge lamp 11 comprising a quartz envelope having a bulb portion 12 and a stem portion 13 extending therefrom. Elongated anode and cathode electrodes 16 and 17 of tungsten or other high temperature refractory metal are positioned along the axis of the lamp, with the inner ends thereof spaced apart within the bulb portion 12. The anode electrode 16 extends through the steam portion 13 and is welded to a molybdenum foil 18 which, in turn, is welded to a lead-in wire 19 which may be of molybdenum or other suitable metal. The foil 18 is sealed in a hot-pressed seal region 21 at the outer end of the stem portion 13, and the lead-in wire 19 extends outwardly from the seal region 21, as shown. The cathode electrode 17 is welded to a molybdenum foil 22, which, in turn, is welded to a cathode lead-in wire 23. The foil 22 is sealed in a hot-pressed seal region 26, and the lead-in wire 23 extends outwardly from the seal region 26. The lamp contains an ionizable gas filling which includes an inert gas such as argon and a halogen or metal halide such as indium iodide. Further details of the lamp 11, and a method of manufacturing it, are disclosed in the above-referenced Fridrich patent and in U.S. Pat. No. 3,685,880 to John Sobieski. The lamp shown is intended for direct current operation, which causes the anode electrode 16 to operate at a considerably higher temperature than the cathode electrode 17, and therefore the anode electrode 16 is made thicker and longer than is the cathode electrode 17.

The high operating temperature of the lamp, which is high enough to cause the inner ends of the electrodes 16 and 17 to become molten during lamp operation, is desirable for achieving high efficiency, a desirable spectrum of light output, and for causing the halogen material within the lamp to become gaseous for causing the above-described regenerative cycling whereby metal vapor from the hot operating electrodes becomes returned to these electrodes rather than becoming deposited on the bulb wall and causing it to darken and thereby reduce the intensity of light output. It is a fortunate characteristic of high temperature refractory metals such as tungsten, molybdenum, etc., which are used for the electrodes 16 and 17, foils 18 and 22, and lead-in wires 19 and 23, that they are relatively poor conductors of heat, as compared to non-refractory metals such as copper, aluminum, etc. This poor heat-conducting characteristic plus the elongated slender shapes of the electrodes 16 and 17 results in relatively little of the desired heat within the bulb 12 from being conducted away along the electrodes 16 and 17 and their associated foils and lead-in wires during operation of the lamp.

U.S. Pat. No. 3,780,342 to Norman Grimshaw and Thomas West discloses a circuit for starting and operating the type of lamp that has just been described. The circuit provides an initial starting pulse of about 8000 volts for starting an arc between the electrodes 16 and 17 within the bulb 12. As the lamp warms up, the circuit automatically reduces the voltage until a final operating voltage of about 40 volts is reached, whereupon the circuit performs a ballasting function to regulate the operating current to the desired value. As has been explained above, if the lamp should cease operating due to a momentary interruption of current thereto, which could be caused by a temporary fluctuation or interruption of current in the power supply, the lamp cannot be restarted for a period of time up to a minute or more. Even applying a very high voltage, much greater than the normal 8000 volts starting pulse, within feasible limits, will fail to restart the lamp during this period of time. This apparently is due to a characteristic of the gas fill within the lamp, whereby the arc cannot be started when the gas is hot and at high pressure, and therefore the lamp must be permitted to cool for a period of time up to a minute or more so that the gas pressure and temperature will be reduced to values such that the arc can be restarted in the lamp. Attempts at hastening the cooling of the lamp upon interruption of its discharge arc, by means of cool jets of air, have not proved feasible.

In accordance with the invention, heat-dissipating means 27 and 28, such as heat sinks in the form of finned metal radiators, are respectively connected to the lead-in wires 19 and 23, externally of the lamp 11. The heat sinks 27 and 28 preferably are in tight-fitting engagement with a substantial length of each of the lead-in wires 19 and 23. In the embodiment shown, each of the heat sink radiators 27 and 28 is of cylindrical configuration and provided with several annular grooves 27*a* and 28*a* therein, respectively.

The heat radiators 27 and 28 do not have any substantial effect on the desired high operating temperature of the lamp, due to the relatively poor heat conductivity of the refractory metal of which the elctrodes 16 and 17 are made and also due to the slender elongated configuration of the electrodes and their associated conductors. However, it has been found that by providing the heat radiators 27 and 28 as shown, they are able to materially affect the cooling rate and thereby dissipate heat from the electrodes 16 and 17 into the ambient surrounding air over a period of several seconds, for example up to about half a minute, whereupon the lamp can be restarted. Thus, the delay in restarting the lamp has been reduced by half. It is believed that this reduction in restart time is due not only to faster cooling of the non-operating electrodes 16 and 17, but is also due to an internal functioning within the lamp wherein the electrodes 16 and 17, by being cooled relatively faster with respect to cooling of the bulb 12, than would be the case without providing the heat radiators 27 and 28, causes the halogen vapor within the lamp to condense on the cooling electrodes 16 and 17 to a relatively great extent. This effect causes a more rapid reduction in gas pressure within the lamp, and also it is believed that the condensed halogen material on the electrodes reduces their work function, thus permitting more reliable lamp restarting at a lower voltage than would otherwise be the case. Some reduction in restart time is achieved by connecting a heat radiator to the terminal of just one electrode.

Contrary to previously known lamp construction techniques, in which heat radiators are attached to lead-in conductors of non-refractory metal such as copper having a relatively large cross-sectional area, so as to facilitate heat conduction from the operating electrode to the heat radiator while the lamp is operating, for the purpose of reducing the operating temperature of the lamp, the construction of the present invention does not substantially affect the desired high operating temperature of the lamp. Instead, the construction of the invention functions when the lamp is not operating, following an accidental interruption of the arc discharge, for the purpose of reducing the time lapse before the lamp can be restarted. The lamp of the invention can be connected across the output terminals 33 and 34 of the above-referenced Grimshaw and West patent, by means of metal clips gripping the heat radiators 27 and 28, whereby the lamp of the invention is substituted for the lamp 35 of the referenced patent.

While a preferred embodiment of the invention has been shown and described, various other embodiments and modifications thereof will be apparent to persons skilled in the art and will be within the scope of the following claims.

What I claim as new and desire to secure by Letters Patent of the United States is:

1. A metal halide high-intensity discharge lamp comprising an envelope and at least one electrode structure sealed therein, said electrode structure comprising an elongated refractory metal electrode extending with said envelope and a conductor extending externally of the envelope, said envelope having a gas fill including a halide, the inner end of said electrode becoming molten during lamp operation, and a heat radiator connected to said conductor externally of said envelope for radiating heat into surrounding air so as to aid the cooling of said electrode upon termination of the discharge without substantially affecting the operating temperature of said electrode.

2. A lamp as claimed in claim 1, in which said heat radiator comprises a finned metal heat radiator.

3. A lamp as claimed in claim 1, including a second electrode structure sealed in said envelope and comprising an elongated refractory metal electrode extending within said envelope with the end thereof spaced from the end of the first-mentioned electrode and also comprising a conductor extending externally of the envelope, one of said electrodes being an anode and the other a cathode, said anode electrode being longer than said cathode electrode, said heat radiator being connected to the conductor of one of said electrode structures.

4. A lamp as claimed in claim 3, in which said heat radiator comprises a finned metal heat radiator.

5. A lamp as claimed in claim 3, including a second heat radiator connected to the conductor of the other one of said electrode structures.

6. A lamp as claimed in claim 5, in which each of said heat radiator comprises a finned metal heat radiator.

* * * * *